US009555958B2

(12) United States Patent
Ozanne et al.

(10) Patent No.: US 9,555,958 B2
(45) Date of Patent: Jan. 31, 2017

(54) METHOD FOR PREPARING A BEVERAGE FROM A CAPSULE, CAPSULE AND BEVERAGE PREPARING SYSTEM

(75) Inventors: Matthieu Ozanne, Champanges (FR); Didier Vuagniaux, Gimel (CH); Alexandre Kollep, Lutry (CH); Gilles Gerber, Lutry (CH)

(73) Assignee: Nestec S.A., Vevey (CH)

( * ) Notice: Subject to any disclaimer, the term of this patent is extended or adjusted under 35 U.S.C. 154(b) by 751 days.

(21) Appl. No.: 13/823,793

(22) PCT Filed: Sep. 13, 2011

(86) PCT No.: PCT/EP2011/065850

§ 371 (c)(1),
(2), (4) Date: Mar. 15, 2013

(87) PCT Pub. No.: WO2012/035012

PCT Pub. Date: Mar. 22, 2012

(65) Prior Publication Data

US 2013/0177677 A1 Jul. 11, 2013

(30) Foreign Application Priority Data

Sep. 15, 2010 (EP) ..... 10176834

(51) Int. Cl.
*B65D 85/804* (2006.01)

(52) U.S. Cl.
CPC ..... *B65D 85/8043* (2013.01)

(58) Field of Classification Search
CPC ..... B56D 85/8043
See application file for complete search history.

(56) References Cited

U.S. PATENT DOCUMENTS

2010/0043646 A1 2/2010 Suggi Liverani et al.
2015/0151905 A1 6/2015 Yoakim et al.

FOREIGN PATENT DOCUMENTS

| | | |
|---|---|---|
| EP | 1580143 | 9/2005 |
| EP | 2100824 | 9/2009 |
| WO | WO2007042415 | 4/2007 |
| WO | 2011035360 | 3/2011 |

OTHER PUBLICATIONS

Russia Office Action for Application No. 2013116971/12(025110), dated Nov. 30, 2015, 7 pages.

*Primary Examiner* — Erik Kashnikow
*Assistant Examiner* — Chaim Smith
(74) *Attorney, Agent, or Firm* — K&L Gates LLP

(57) ABSTRACT

The invention relates to a method for preparing a beverage through a capsule (2) inserted in a beverage machine; the capsule (2) comprising an enclosure (20) containing one or more beverage ingredients, wherein a brewing fluid is introduced in the enclosure (20) to brew said one or more beverage ingredients, characterized in that: a discharge wall (3, 3B, 300, 310, 320, 330) is placed in association with the enclosure (20), wherein the discharge wall (3, 300, 310, 320, 330) comprises discharge means (100, 301, 311, 321, 331) which restrain the brewed liquid from being discharged from the capsule (2) or limit the liquid flow in case the pressure inside the enclosure (20) is below a predetermined value, and the discharge means (100, 301, 311, 321, 331) enable the delivery of the brewed liquid in case the pressure exceeds said predetermined value.

6 Claims, 3 Drawing Sheets

METHOD FOR PREPARING A BEVERAGE FROM A CAPSULE, CAPSULE AND BEVERAGE PREPARING SYSTEM

CROSS REFERENCE TO RELATED APPLICATIONS

The present application is a National Stage of International Application No. PCT/EP2011/065850, filed on Sep. 13, 2011, which claims priority to European Patent Application No. 10176834.9, filed Sep. 15, 2010, the entire contents of which are being incorporated herein by reference.

BACKGROUND OF THE INVENTION

The present invention relates to a method for preparing and delivering a beverage from a capsule that contains one or more beverage ingredients as well as the capsule for preparing and delivering the beverage in a brewing device. The present invention more particularly aims at providing a method for brewing tea from capsules and a beverage machine as well as a capsule adapted to deliver brewed tea, although other beverages can be successfully brewed by this method and in this capsule.

Different beverage preparation methods using capsules to be brewed in a suitable beverage machine are known. Quality of a tea beverage is highly dependent on the quality of the leaf tea ingredients, i.e., the tea origin used (soil, drying, blending, etc.) and their storage conditions. For instance, tea ingredients are usually sensitive to oxygen and light. Preferred tea ingredients are taken from loose leaves, chiselled or broken in small fragments. However, brewing conditions are also important to take full advantage of the quality of the starting ingredients used.

Another problem with tea beverages resides in that taste cross-contamination must be preferably avoided. Taste cross-contamination happens when two capsules are successively brewed in the machine and when a taste residue is left by the first capsule on permanent parts of the machine that can consequently affect the taste of the second capsule which is brewed just after the first capsule. For tea, this can be an issue with certain tea varieties that deliver a high aroma profile such as mint tea or other highly flavoured varieties. Also tea residue may constitute a soil for bacterial growth and may lead to hygiene issues which need to be tackled.

WO 2007/042414 A1 and WO 2007/042415 A1 propose a design of a capsule that promotes optimal conditions for the preparation of a tea beverage and the like. In particular they propose a capsule that is adapted to brew or infuse beverages in a beverage machine that may provide the following advantages: the quality of the tea beverage can be improved, in particular, in relation to the beverage concentration into the cup, the taste and the reduced turbidity. For these purposes the capsule comprises: an enclosure containing one or more beverage ingredients; a filtering wall delimiting at least one filtering side of the enclosure, wherein it comprises an overflow wall that is positioned in the path of the brewed liquid after the filtering wall and which comprises at least one overflow aperture. Since the production of such a capsule requests the assembly of different elements in a certain order—that is the positioning of a filter means through the capsule enclosure opening and then of an overflow wall on the filter means—the production of the capsule is complex and expansive.

Therefore, there is a need for a capsule that is easier and less expensive to be produced while presenting a design that promotes optimal conditions for the preparation of a tea beverage and the like.

SUMMARY OF THE INVENTION

In the present application, the terms "capsule" or "cartridge" or "package" are considered as synonymous. The term "capsule" will be preferentially used. The capsule can be a single use capsule hermetically closed before its use for the preparation of a beverage or it can be a reusable capsule that is openable to introduce desired food ingredients inside before use. The words "brewing" or "infusion" are used as synonymous. The term "brewing fluid" generally refers to the liquid that serves to infuse the beverage ingredients, more generally, hot water. The term "brewed liquid" generally refers to the liquid that has infused and submerged the beverage ingredients, more generally, tea or the like.

In the present application, the term "tea" encompasses all type of leaf tea such as green tea, black tea, white tea, chai tea, flavoured tea, herbal or fruit tea and combinations thereof. The term "leaf tea" or "leaf ingredient" refers to brewable tea or other ingredients in whatever form such as complete, cut or chiselled leaves, small fragments of leaves, powder or dust.

The present invention provides a new way to brew or infuse beverage from a beverage capsule in a beverage machine as well as a capsule that is adapted therefore and that provide the following advantages:

- the quality of the beverage can be maintained, in particular, in relation to the beverage concentration into the cup, a good taste and a reduced turbidity,
- a capsule that is less complicated and less expensive to produce, and a method that involves said capsule
- the beverage delivery is cleaner and it reduces or eliminates the taste cross-contamination and hygiene issues.

For these purposes as well as many others possible, the invention according to a first aspect relates to a method for preparing a beverage through a capsule inserted in a beverage machine, the capsule comprising an enclosure containing one or more beverage ingredients, wherein a brewing fluid is introduced in the enclosure to brew said one or more beverage ingredients, and wherein a discharge wall is placed in association with the enclosure and the capsule is positioned in the machine during beverage preparation so that the discharge wall is vertically oriented. Further, according to the invention, the discharge wall comprises discharge means which restrain the brewed liquid from being discharged from the capsule or limit the liquid flow in case the pressure inside the enclosure is below a predetermined value, and the discharge means enable the delivery of the brewed liquid in case the pressure exceeds said predetermined value.

Therefore, according to the first aspect of the method of the invention, and without willing to be bound to any theoretical model, an effect can be obtained to enable the beverage ingredients to be submerged by the fluid, therefore avoiding bypassing areas and ensuring that the mass of ingredient fully interacts with the brewing fluid, and thus, a well mixed brewed liquid can leave the capsule and becomes dispensed once the pressure exceeds the predetermined value.

According to a first embodiment, the discharge means can be a discharge opening which may comprise a hole which increases its section when the pressure inside the enclosure is rising. In this case, the discharge wall is preferably made up of a flexible, preferably resilient or elastic, material such as a silicone membrane to enable the increase in section while at the same time forming a watertight wall being impermeable in its discharge opening portions as long as the pressure is below said predetermined value. It can also be an elastic fibres woven material or the like. Hence, the discharge wall, or better the discharge means in said wall limits the flow of fluid to the outlet when a low fluid pressure is applied thereon, and the flow of fluid to the outlet can be increased when the pressure inside the capsule increases. That is when the capsule enclosure is full of water and the water pump goes on introducing water in the enclosure, the pressure raises, the discharge means increases its section and the liquid flow thus slowly increases as well, such that the ingredients will have been thoroughly submerged until the predetermined pressure value has been reached.

According to a second embodiment, the discharge means may comprise a flexible valve such as a bicuspid-like valve, a tricuspid-like valve or a tetracuspid-like valve. The discharge wall of the second embodiment can be made up of the same material as the discharge wall according to the first embodiment. Additionally or alternatively, both the discharge opening and the flexible valve, i.e., the beforementioned discharge means, can be contracted to close the discharge means, i.e., thus closing the discharge wall, when the pressure is below the predetermined value, and the discharge means can be expanded to open the discharge means, i.e., thus opening the discharge wall, when the pressure exceeds the predetermined value. An advantage of these two first modes is that at the end of the preparation of the beverage, the water pump stops introducing water in the enclosure of the capsule then the pressure inside the capsule decreases and either the hole section decreases or the valve closes. Then the discharge wall is closed and prevents the liquid that is still inside the capsule to leak therefrom during the ejection of the capsule from the beverage machine which makes the beverage preparation method cleaner.

According to a third embodiment, the discharge means is a discharge opening comprising a hole with fixed diameter sufficiently small to create a watertight wall when brewing fluid is introduced without pressure, and to let brewed liquid flow there through when the pressure exceeds the predetermined value. In this case, the discharge wall can be made of a plastic material comprising said at least one hole. It can also be a plastic, paper or textile filter. By means of said feature, the ingredients can be thoroughly submerged before the predetermined pressure value has been reached and the water, i.e., the brewed beverage is forced to exit the enclosure via the discharge means, i.e., the holes when the predetermined value has been exceeded.

Preferably, the discharge wall extends substantially along a whole transversal section of the enclosure, more preferably substantially from the bottom of the enclosure to the top of the enclosure. The discharge wall thus creates a sufficiently large surface for the brewed liquid that favours a lower brewing pressure in the enclosure and a slow flow velocity while the flow rate can stay within the acceptable range. Thus, the predetermined pressure can be adjusted and set more accurately and the ingredients can be thoroughly submerged. Preferably the discharge wall presents a valve opening section or a hole section (i.e. discharge means) sufficiently small to act as a filter and prevent solid food ingredients like tea leaves to go through them.

By the method of the invention, the brewing fluid enters the enclosure at a relative pressure below 0.2 bar, preferably, below 0.1 bar and most preferably from atmospheric pressure to a value below 0.1 bar.

In the present context, the "relative pressure" is meant to be the pressure that is measured just outside of the fluid inlet of the capsule (and downstream an eventual backpressure valve) and refers to the value of pressure above the ambient atmospheric pressure.

According to the method of the invention, the brewed liquid can be conducted downward from the discharge means through a beverage conduit to a beverage outlet. Therefore, the brewed liquid can be dispensed properly and hygienically into the recipient (cup, mug, . . . ) while keeping a simple capsule construction and promoting an easy handling of the capsule in the machine.

For this, the method of the invention contemplates the positioning of the capsule substantially vertically and the carrying of the beverage from the discharge means to the beverage outlet in a downward direction. As a result, fluid can be collected and mixed in the enclosure, and after being discharged through the discharge means when exceeding the predetermined pressure value inside the enclosure, beverage is then dispensed downwards while the capsule can be positioned vertically in the machine. This approach provides significant advantages over the existing systems that prone a horizontal arrangement of the capsule in the machine. In the present invention, not only the flow can be controlled more slowly through the capsule for a better infusion quality but the whole capsule system is greatly simplified and the handling of the capsule is easier. Indeed, as the capsule can be placed vertically, capsule insertion and capsule removal is facilitated since the capsule can be inserted vertically from the top of the machine and it can be removed during opening of the machine along the same axis or direction by simple gravity and without need for complicated ejection devices and/or user's intervention.

In a preferred embodiment, the beverage conduit and the beverage dispense outlet are parts of the capsule and the beverage flows out of the capsule without direct contact with machine parts. This provides the additional benefits that cleaning or rinsing of the machine part is no longer required and taste cross-contamination can be so eliminated.

If necessary, an additional filter media can be used to prevent fines of food ingredients to go through the discharge openings of the discharge means.

In an embodiment, fluid can be introduced in the capsule through an entry wall of the enclosure that is opposed to the discharge wall. Again, contrary to the teaching of the prior art, fluid can be introduced on any possible side of the capsule. Preferably, the fluid is introduced from the opposed side while keeping all the benefits of the invention, i.e., slow flow for high quality infusion, controlled guidance of the beverage to the cup, reduced cross-contamination and easy handling of the capsule in the machine. This "opposed side" approach is even preferred because first it ensures that water can traverse fully though the ingredients and it also leaves more room for placing the injection fluid system on one side and it so contributes to the compactness of the capsule system (both capsule and machine).

The invention according to a second aspect relates to a capsule for the preparation of a beverage in a beverage machine comprising an enclosure containing one or more beverage ingredients to be brewed, and a discharge wall that is positioned in the path of the brewed liquid (i.e., in association with the enclosure) and which comprises discharge means configured to restrain the brewed liquid from being discharged from the capsule or limit the liquid flow in case the pressure inside the enclosure is below a predetermined value, and configured to enable the delivery of the brewed liquid in case the pressure exceeds said predetermined value.

According to a first embodiment, the discharge means can be a discharge opening preferably comprising a hole configured to increase its section when the pressure inside the enclosure is rising.

According to a second embodiment, the discharge means can comprise a flexible valve such as a bicuspid-like valve, a tricuspid-like valve or a tetracuspid-like valve.

Additionally or alternatively, the discharge means is preferably designed such that it is contracted to close the discharge means, i.e., thus closing the discharge wall, when the pressure is below the predetermined value, and expanded to open the discharge means, i.e., thus opening the discharge wall, when the pressure exceeds the predetermined value.

According to the before-mentioned embodiments, the discharge wall can be made up of a flexible or elastic or resilient material such as a silicone membrane or the like.

According to a third embodiment, the discharge wall can comprise a textile material, paper or plastic filter having the at least one discharge means, wherein the discharge means is a discharge opening comprising a hole with fixed diameter being designed to be sufficiently small to create a watertight wall when brewing fluid is introduced without pressure, and brewed liquid is able to flow through the at least one hole when the pressure exceeds the predetermined value.

Preferably, the discharge wall extends substantially from the bottom of the enclosure to the top of the enclosure.

Preferably, the capsule comprises a shell and the discharge wall closes said shell. More preferably, the capsule comprises a cover that is attached to the shell and faces the discharge wall.

Preferably, the cover comprises a beverage flow guiding means configured to guide the beverage flow to a beverage outlet of the capsule.

Therefore, the brewed liquid can be dispensed properly and hygienically into the recipient (cup, mug, . . . ) while keeping a simple capsule construction and promoting an easy handling of the capsule in the machine.

Preferably, the at least one ingredient is tea.

Additionally, the enclosure can be impermeable to gas and light.

The discharge wall thus comprises at least one discharge means. The discharge wall can be internal to the capsule and protected by an outer closing membrane. The closing membrane can close the capsule in a gastight manner to improve the maintenance of freshness of the ingredients contained in the enclosure.

The invention also relates to a beverage capsule system for preparing a beverage comprising:

- a beverage capsule comprising an enclosure containing one or more beverage ingredients and a discharge wall placed in association with the enclosure,
- a brewing device comprising capsule handling members that maintain the capsule in a determined brewing position where the capsule discharge wall is vertically oriented.

Further the discharge wall comprises discharge means which restrain the brewed liquid from being discharged from the capsule or limit the liquid flow in case the pressure inside the enclosure is below a predetermined value, and the discharge means enable the delivery of the brewed liquid in case the pressure exceeds said predetermined value.

DETAILED DESCRIPTION OF THE DRAWINGS

Embodiments of the present invention will now be described, by way of example only, with reference to the accompanying drawings, in which.

DETAILED DESCRIPTION OF THE INVENTION

Figure 1:
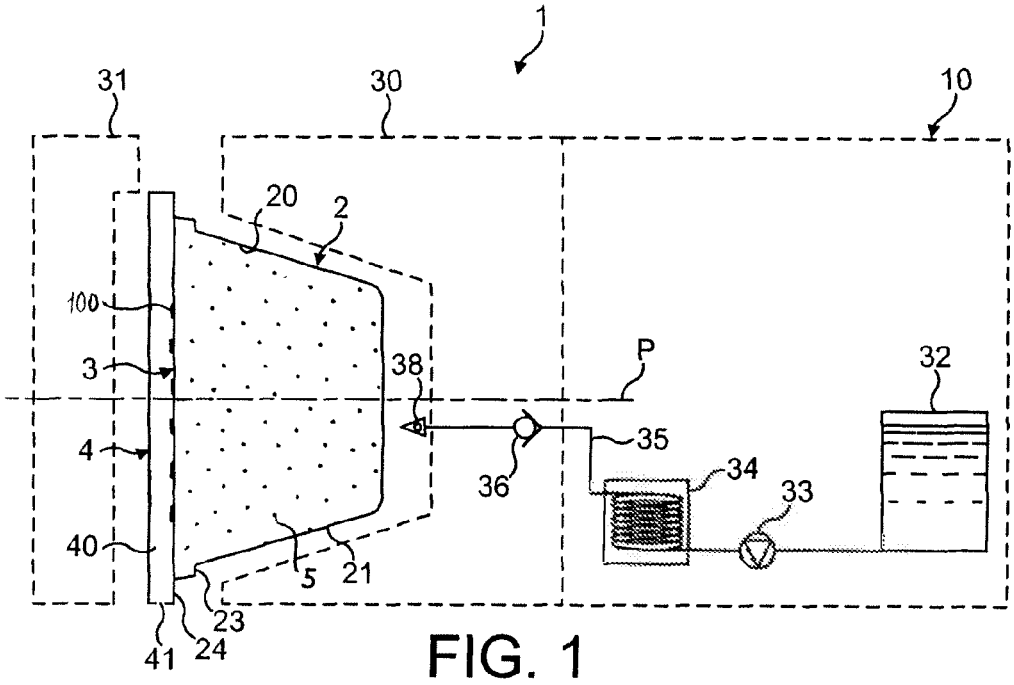
FIG. 1 is a schematic illustration of a capsule brewing system before brewing for carrying out the method according to the invention.

The general principle of the method of the invention will now be explained in relation to FIGS. 1 and 2.

A capsule system 1 is provided that comprises a capsule 2 and a beverage brewing device 10. For simplicity, the beverage brewing device is only schematically depicted and may, in reality, comprise additional technical features within the normal knowledge of the person skilled in the art. The capsule comprises an enclosure 20 containing beverage ingredients 5 such as leaf tea and the like. The enclosure 20 is demarcated by a cup-shaped housing or shell 21 and a discharge wall 3.

The enclosure 20 is preferably impermeable to gas and light. The housing 21 may encompass different cross sections such as a circular, ellipsoid, square, rectangular or polygonal section that determine as a matter of fact the general profile of the discharge wall 3. The enclosure 20 is sized to accommodate a dose of leaf beverage ingredient 5 of typically about between 1 to 10 grams, preferably 2 to 5 grams. The dose of leaf ingredient 5 may depend on the final volume of beverage to produce. For an individual cup of tea, a typical dose can be of about 2 grams whereas for a tea pot, a typical dose can be of about 8 to 10 grams. As clearly apparent in FIG. 1, the capsule 2 is positioned relative to the brewing device 10 so that the discharging wall 3 extends substantially vertical and from substantially the bottom of the enclosure 20 to the top of the enclosure 20. For this, the capsule 2 is preferably positioned in a "vertical" arrangement in the brewing device 10. The cup-shaped housing 21 can be so oriented with its large opening and its bottom oriented in a vertical position.

The capsule 2 is preferably closed by the discharge wall 3 that closes the enclosure 20. The discharge wall 3 is attached, for instance, to a peripheral outer rim 24 of the cup-shaped housing 21.

The capsule 2 can further comprise a cover member 4 that is also attached to the rim 24 of the housing and overlaps the discharge wall 3. The cover 4 forms an internal channel (beverage conduit) 40 that terminates at its side end by an outlet (beverage outlet) 41. According to a preferred embodiment, the beverage conduit 40 and the beverage outlet 41 are parts of the capsule 2. Therefore, the brewed liquid can be dispensed properly and hygienically into the recipient (cup, mug, . . . ) while keeping a simple capsule 2 construction and promoting an easy handling of the capsule 2 in the machine. However, it is also possible that both the beverage conduit and the beverage outlet are parts of the beverage machine.

The shape of the capsule 2 is not very critical. Preference is given to a trunconical, ellipsoidal or hemispherical shapes for different reasons. This allows a larger surface for the exit of the beverage through the discharge wall 3 and a reduction of the inside pressure. The housing 21 can also be manufactured industrially at lower cost by plastic thermoforming or aluminium or aluminium-plastic deep drawing. This shape with smoother corners also favours the removal of handling members 30, 31 of the brewing device 10 and so the ejection of the capsule 2.

As described above, the housing has the peripheral rim 24 that extends as a flange to constitute a substantially flat sealing portion onto which can be sealed the discharge wall 3 and snap fitted and/or sealed the cover member 4.

At the rear of the housing 21, the wall of the housing 21 can comprise a raising zone that constitutes the injection region for the introduction of the fluid in the capsule 2. The raising zone is so conceived to resist to compressive forces of an injection device 38 and to puncture at its centre more easily.

Turning to the brewing device 10, it comprises the capsule handling members 30, 31 that are configured to hold the capsule 2 in the "vertical" arrangement as defined. These handling members 30, 31 can be machine jaws or any suitable mechanical enclosing means that can open and close about the capsule 2 and can maintain it firmly in place. There is no need for providing high closing forces since the involved fluid pressure in the capsule 2 remains relatively low and, preferably, as close as possible to the atmospheric pressure. Also, since the capsule 2 can withstand the low brewing pressure therefore the capsule 2 does not necessarily need to be entirely enclosed but simply held water tightly in place during brewing. This participates to a simplification of the machine and reduces machine costs.

The brewing device 10 comprises a water supply 32, such as a water tank, a water pump 33, a heater 34 and a hot water injection line 35 that is managed through the handling member 30. The brewing device 10 may also comprise a controller and a user interface board (not shown) to manage the beverage preparation cycles as known in the art. A backpressure valve 36 can be provided to lower the pressure at the entry side or injection member 38 (such as a needle(s) or blade(s) and a water inlet) in the capsule 2. Of course, the backpressure valve 36 could be omitted and a low pressure pump could be used that delivers fluid at low pressure. Medium to high pressure pump may however be preferred because of their robustness and reliability and so used in combination with a backpressure valve 36.

Importantly, in the brewing operation shown in FIG. 2, the capsule 2 comprises discharge means 100 (as will be described later on in detail) such as discharge openings or flexible valves placed at predefined positions on/in the discharge wall 3.

According to the invention, the discharge wall 3 is positioned in association with the enclosure 20 in the path of a brewed liquid and comprises the discharge means 100 configured to restrain the brewed liquid from being discharged from the capsule 2 or limit the liquid flow in case the pressure inside the enclosure 20 is below a predetermined value, and enable the delivery of the brewed liquid in case the pressure exceeds said predetermined value.

Hence, the beverage ingredients can be thoroughly submerged by the fluid, therefore avoiding bypassing areas and ensuring that the mass of ingredient fully interacts with the brewing fluid, and thus, the liquid can be well mixed due to the rising pressure. Finally, well mixed brewed liquid leaves the capsule 2 via the discharge means 100 once the pressure exceeds the predetermined value.

With respect to FIGS. 3 to 6 there will be now described four embodiments of a discharge wall or discharge means, respectively, according to the invention.

Figure 3A:
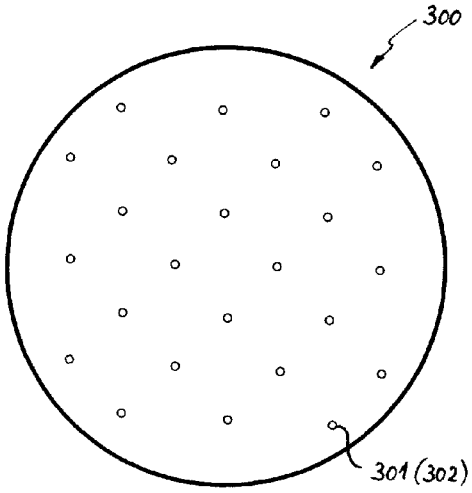
FIG. 3A is a perspective view of a discharge wall according to a first aspect.
Figure 3B:
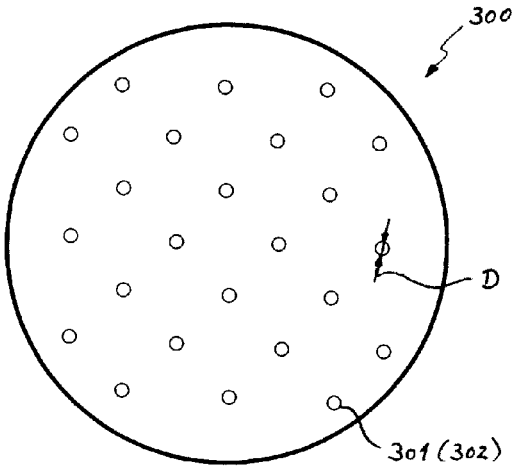
FIG. 3B is a perspective view of the discharge wall of FIG. 3A when enabling the delivery of the liquid.

In a preferred embodiment according to FIGS. 3A and 3B, a discharge wall 300 according to a first embodiment will be described. The discharge wall 300 comprises a discharge means being formed as a discharge opening 301. Said discharge opening 301 comprises a hole 302 being designed such that it increases its section "D" when the pressure inside the enclosure 20 is rising. Therefore, the discharge wall 300 is preferably made up of an eleastic or resilient material such as a silicone membrane or an elastic fibres woven material. Hence, the discharge means 301 comprises holes 302 which have a section or diameter such that no liquid or only a limited flow of liquid is dispensed when a low fluid pressure is applied on the discharge wall 300, i.e., is present inside the enclosure 20 (see FIG. 3A). Thus, the ingredients can be thoroughly submerged while only a low pressure is applied. In case the pressure increases when the capsule enclosure 20 is full of brewing fluid like water and the water pump goes on introducing water in the enclosure 20, the discharge wall can deform itself due its elastic nature and becomes rounded. This deformation also deforms the holes 302 of which section increases. Then, the discharge means 301 can open or (slowly) increase the liquid flow when exceeding the predetermined value thus dispensing the thoroughly submerged, brewed and mixed beverage (see FIG. 3B).

Even if a specific number of discharge openings 301 are shown in this embodiment, the invention is not limited to the number and particular arrangement thereof. In fact, the discharge wall 300 may comprise at least one or a plurality of said discharge openings 301 being arbitrarily or evenly distributed.

Figure 4A:
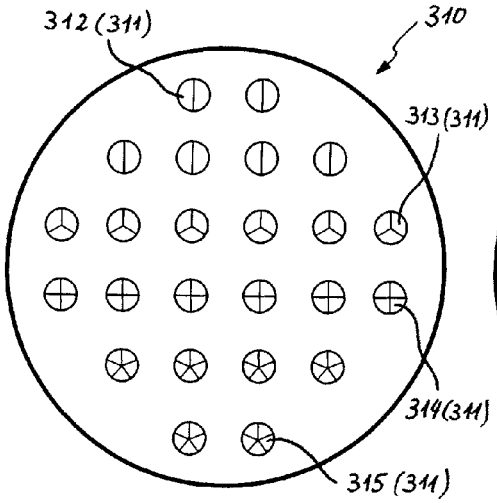
FIG. 4A is a perspective view of a discharge wall according to a second aspect.
Figure 4B:
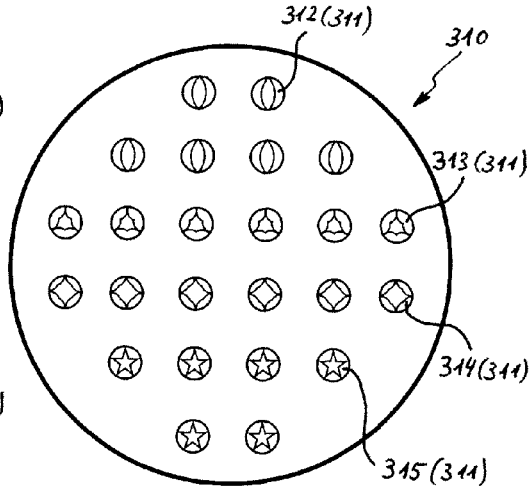
FIG. 4B is a perspective view of the discharge wall of FIG. 4A when enabling the delivery of the liquid.

According to another embodiment as shown in FIGS. 4A and 4B, the discharge wall 310 comprises a discharge means comprising a flexible valve 311. The flexible valve is preferably formed as a multiplecuspid-like valve such as a bicuspid-like valve 312, a tricuspid-like valve 313, a tetracuspid-like valve 314 and/or a heptacuspid-like valve 315. For the sake of simplification, there are many different types of multiplecuspid-like valves shown in FIGS. 4A and 4B. However, there is preferably used only one type of such valves per discharge wall 310; but the invention is not limited thereto. Moreover, the invention is also not limited to the number and arrangement of the valves as shown in the embodiment, but there can be provided at least one or a plurality of valves of any of the before-mentioned types being arbitrarily or evenly distributed.

Said (multiplecuspid-like) flexible valve 311 can be designed such that it is sealably closed in case a liquid acts on said valve 311 with a pressure being below a predetermined pressure value (see FIG. 4A). Moreover, the valve 311 can be adjusted such that it opens when the liquid pressure exceeds said predetermined value (see FIG. 4B). In this case, the valve 311 can create a comparatively large opening such that the brewed liquid, after having thoroughly submerged the ingredients, can be easily and quickly dispensed from the machine.

Figure 5A:
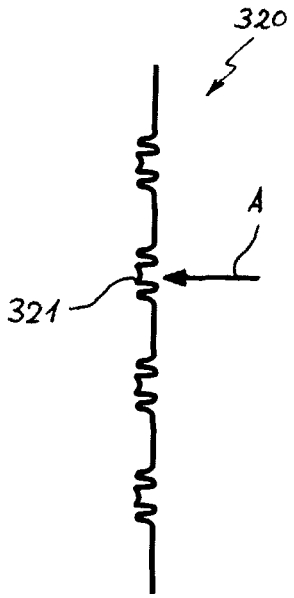
FIG. 5A is a perspective side view of a discharge wall according to a third aspect.
Figure 5B:
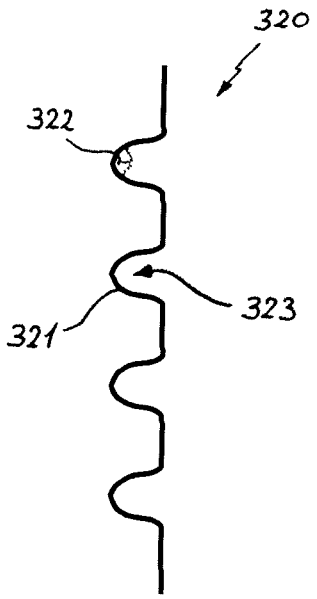
FIG. 5B is a perspective side view of the discharge wall of FIG. 5A when enabling the delivery of the liquid.

According to a further embodiment of the invention as shown in FIGS. 5A and 5B, the discharge means of the discharge wall 320 preferably comprises a discharge valve 321, which discharge means 321 is designed such that it is contracted to close the discharge means 321 (and thus the discharge wall 320) when the pressure is below the predetermined value, and expands to open the discharge means 321 (and thus the discharge wall 320) when the pressure exceeds the predetermined value. Such valves 321 are also known from bottles being stored containing viscous liquids or spreads such as honey or ketchup; preferably having an outlet portion 322 designed as a multiplecuspid-like valve according to the second embodiment or with a small hole according to the first embodiment.

In the contracted state, the discharge valve 321 preferably everts such that its outlet portion 322 is directed to the enclosure 20 and thus against the liquid pressure (see arrow "A") such that it is even better sealably closed (see FIG. 5A). When exceeding the predetermined pressure value, the discharge valve 321 expands and everts the other way round such that its outlet portion 322 expands away from the enclosure 20 and thus forming a channel 323 for guiding the brewed liquid to the outlet portion 322 (e.g. a tricuspid-like valve) where the liquid can be easily discharged.

Again, the number and arrangement of the discharge means or discharge valves 321 as shown in the embodiment of FIGS. 5A and 5B is not restrictive, but there can be provided at least one or a plurality of such valves 321 being arbitrarily or evenly distributed.

Figure 6:
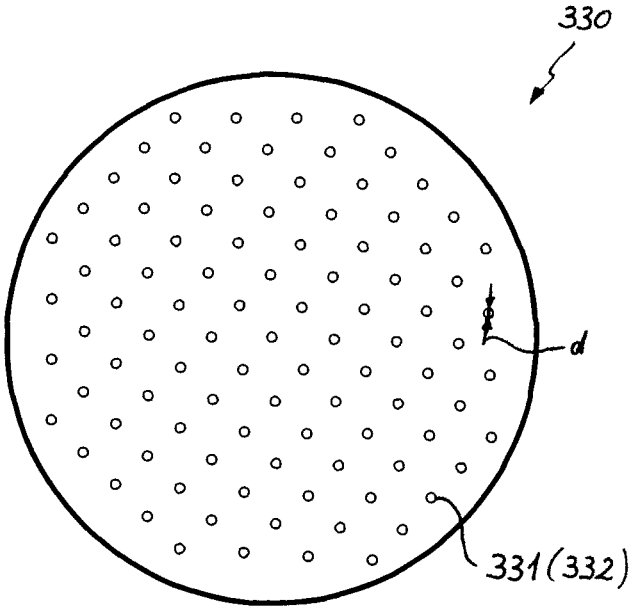
FIG. 6 is a perspective view of a discharge wall according to a fourth aspect.

According to another embodiment as shown in FIG. 6, the discharge means of the discharge wall 330 is a discharge opening 331 comprising a hole 332 with fixed diameter "d". The diameter "d" of said hole 332 is, however, sufficiently small to create a watertight wall when brewing liquid is introduced without pressure. When the pressure exceeds the predetermined value—preferable below 0.2 or even below 0.1 bar—liquid (e.g. a brewed beverage like tea) is able to flow through the at least one hole 332, i.e., the liquid is forced through said openings 331 when exceeding the predetermined pressure value. The discharge wall 330 according to this embodiment preferably comprises a watertight material so that the liquid can only flow through the openings under pressure. The material can be a plastic filter having the at least one discharge opening 331. The material can also be a plastic, paper or textile filter, either woven or non woven, with a low permeability to water so that water cannot permeate through its holes if the water flow does not reach a certain pressure. The number and arrangement of the discharge openings 331 as shown in the embodiment is not restrictive, but there can be provided at least one or a plurality of such openings 331 being arbitrarily or evenly distributed.

In a preferred embodiment, the discharge wall presents a valve opening section or a hole section (=discharge means) sufficiently small to act as a filter and prevent solid food ingredients like tea leaves to go through them. If necessary, an additional filter media can be used to prevent fines of food ingredients to go through the openings of the discharge means. The filter media can be, for instance, fixedly attached to a peripheral inner step 23 of the housing 21.

The capsule and the method of the present invention can be used with a beverage preparation machine such as described in WO 2007/134960 A1.

Figure 2:
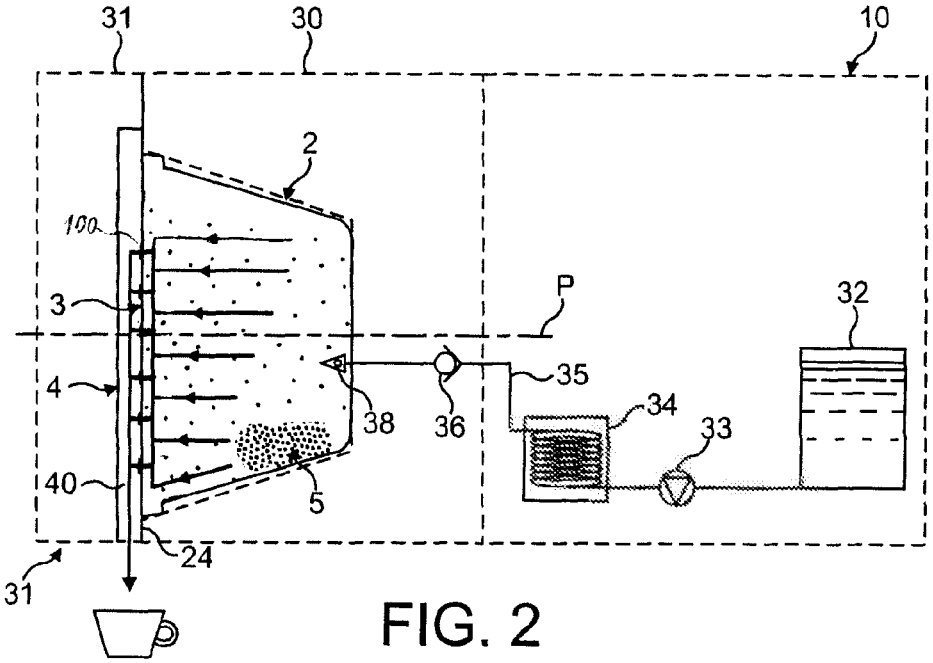
FIG. 2 is a schematic illustration of the capsule brewing system of FIG. 1 during brewing of the capsule.

The principle of the brewing method according to FIGS. 1 and 2 encompasses different variants and equivalences and is not limited by the embodiments described above as long as they are covered by the following claims.

The invention claimed is:

1. A capsule for the preparation of a beverage in a beverage machine, the capsule comprising:

an enclosure containing one or more beverage ingredients to be brewed; and a discharge wall that is designed to be positioned in a path of a brewed liquid and which comprises a discharge member configured to prevent the brewed liquid from being discharged from the capsule or limit a liquid flow when a pressure inside the enclosure is below a predetermined value, and to enable delivery of the brewed liquid when the pressure exceeds the predetermined value, the discharge wall extending substantially from a bottom of the enclosure to a top of the enclosure, and the discharge wall consisting of a flexible or elastic material.

2. The capsule according to claim 1, wherein the discharge member comprises at least one discharge opening comprising a hole configured to increase a size of the opening when the pressure inside the enclosure increases.

3. The capsule according to claim 1, wherein the discharge member is designed to be closed when the pressure is below the predetermined value and opened when the pressure exceeds the predetermined value.

4. The capsule according to claim 1, wherein the discharge wall is made of a plastic material, and the discharge member comprises at least one discharge opening comprising a hole with a fixed diameter designed to be sufficiently small to create a watertight wall when the brewed fluid is introduced without pressure, and the brewed liquid is able to flow through the at least one discharge opening when the pressure exceeds the predetermined value.

5. The capsule according to claim 1, wherein the discharge member comprises at least one flexible valve.

6. A beverage capsule and a brewing device for preparing a beverage comprising:

the beverage capsule comprising an enclosure containing one or more beverage ingredients and a discharge wall placed in association with the enclosure; and the brewing device comprising capsule handling members that maintain the capsule in a determined brewing position where the discharge wall is vertically oriented, the discharge wall comprising a discharge member which prevents a brewed liquid from being discharged from the capsule or limits a liquid flow in case a pressure inside the enclosure is below a predetermined value, the discharge member allowing delivery of the brewed liquid in case the pressure exceeds the predetermined value, the discharge wall extending substantially from a bottom of the enclosure to a top of the enclosure, and the discharge wall consisting of a flexible or elastic material.

* * * * *